US009968148B2

(12) United States Patent
Gibbons et al.

(10) Patent No.: US 9,968,148 B2
(45) Date of Patent: May 15, 2018

(54) NURSING COVER-UP

(75) Inventors: Haley Gibbons, Wheatridge, CO (US); Clarice Bonzer, Littleton, CO (US)

(73) Assignee: The Boppy Company, LLC, Golden, CO (US)

( * ) Notice: Subject to any disclaimer, the term of this patent is extended or adjusted under 35 U.S.C. 154(b) by 793 days.

(21) Appl. No.: 12/968,842

(22) Filed: Dec. 15, 2010

(65) Prior Publication Data

US 2012/0151657 A1 Jun. 21, 2012

(51) Int. Cl.
*A41D 1/20* (2006.01)
*A41F 1/00* (2006.01)

(52) U.S. Cl.
CPC ..... *A41F 1/008* (2013.01); *A41D 1/215* (2018.01)

(58) Field of Classification Search
USPC ... 2/46, 48, 49.1, 49.3, 49.4, 49.5, 104, 247, 2/249, 251, 336, 338, 451, 453, 50, 51, 2/88, 94, 182.2, 207, 244, 245, 69.5; 5/494
See application file for complete search history.

(56) References Cited

U.S. PATENT DOCUMENTS 2,317,176 A * 4/1943 Byrd ..... 2/48
2,616,598 A * 11/1952 Sexton ..... 2/48
2,884,638 A * 5/1959 Ream ..... 2/48
3,004,315 A * 10/1961 Masure ..... 24/3.7
3,665,880 A * 5/1972 Ambrose ..... 112/417
3,693,634 A * 9/1972 Gilbert ..... 132/212
D231,810 S * 6/1974 Daley ..... D2/862
4,004,294 A 1/1977 Pinch
4,106,122 A 8/1978 Dodd
4,144,593 A 3/1979 Timmons
4,208,743 A 1/1980 Whitcarft
4,446,572 A 5/1984 Lindquist
4,458,365 A 7/1984 Wood
4,468,816 A 9/1984 Kaufer
4,601,068 A 7/1986 Frechette
4,712,251 A 12/1987 Cobble
4,713,842 A 12/1987 Patterson
4,716,597 A 1/1988 Griggs
4,797,953 A 1/1989 Dameron
4,864,172 A 9/1989 Dodt
D303,995 S 10/1989 Dameron
D306,510 S 3/1990 Sanchez
4,924,528 A 5/1990 Trombetti-Dickens
(Continued)

OTHER PUBLICATIONS

Printed from Internet: http://shop.bebeaulait.com/originals.
(Continued)

*Primary Examiner* — Sally Haden
(74) *Attorney, Agent, or Firm* — Kilpatrick Townsend & Stockton LLP

(57) ABSTRACT

In one embodiment, a nursing cover is constructed of a flexible cover body that is configured to cover a mother's front, particularly areas exposed while nursing a baby. For convenience of reference, the cover body can be described in terms of a top end, a bottom end and two sides. A track is coupled to the top end of the cover, and at least one clip is slidingly engaged with the track to permit the clip to slide along the track. In this way, not only does the cover provide privacy protection to a nursing mother, but the cover also includes a slidable clip that can serve a variety of functions.

12 Claims, 4 Drawing Sheets

(56) References Cited

U.S. PATENT DOCUMENTS

| | | | | |
|---|---|---|---|---|
| 5,008,960 | A | | 4/1991 | Hemming |
| 5,034,999 | A | | 7/1991 | Lubbers |
| 5,038,411 | A | | 8/1991 | St. Armand |
| 5,042,090 | A | | 8/1991 | Cook |
| 5,090,059 | A | | 2/1992 | Kahl |
| 5,133,085 | A | | 7/1992 | de Pasquale Amicarelli et al. |
| 5,182,813 | A | | 2/1993 | Booze |
| 5,259,068 | A | | 11/1993 | Carroll |
| 5,440,762 | A | | 8/1995 | Schill |
| 5,469,582 | A | | 11/1995 | Livingston |
| 5,479,662 | A | | 1/1996 | Runco |
| 5,544,364 | A | | 8/1996 | Weber |
| 5,570,474 | A | | 11/1996 | Berry et al. |
| 5,611,086 | A | | 3/1997 | Eggen |
| 5,652,958 | A | | 8/1997 | Farrell-Mestas |
| 5,652,960 | A | | 8/1997 | Kaknevicius |
| 5,678,285 | A | * | 10/1997 | Germani ..... 24/418 |
| D395,188 | S | | 1/1998 | Rush |
| D393,737 | S | | 4/1998 | Tymous |
| 5,848,439 | A | | 12/1998 | Huseth et al. |
| 5,893,171 | A | | 4/1999 | Ries |
| 5,956,762 | A | | 9/1999 | Adams |
| 6,109,765 | A | * | 8/2000 | Blanton ..... 362/249.16 |
| 6,216,273 | B1 | | 4/2001 | Williams |
| 6,327,712 | B1 | | 12/2001 | Armstrong et al. |
| 6,378,135 | B1 | | 4/2002 | Hemming et al. |
| 6,442,759 | B1 | * | 9/2002 | Straham et al. ..... 2/49.1 |
| 6,581,209 | B2 | | 6/2003 | Bramhan |
| 6,702,381 | B2 | * | 3/2004 | Endicott et al. ..... 297/256.17 |
| 7,188,372 | B2 | | 3/2007 | Stockard |
| D542,509 | S | | 5/2007 | Campbell et al. |
| 7,219,373 | B2 | * | 5/2007 | McNamara ..... 2/48 |
| D442,329 | S | | 10/2007 | McCoy |
| 7,406,718 | B2 | | 8/2008 | Ekelund et al. |
| 7,409,727 | B2 | | 8/2008 | Ekelund et al. |
| 7,490,362 | B2 | | 2/2009 | Owen |
| 7,555,790 | B2 | | 7/2009 | Ostrander |
| 7,636,949 | B1 | * | 12/2009 | Shooshan ..... 2/48 |
| 7,640,600 | B2 | | 1/2010 | Reder |
| 7,694,350 | B2 | | 4/2010 | Hodges et al. |
| 7,805,770 | B2 | | 10/2010 | Ekelund et al. |
| 7,805,771 | B2 | | 10/2010 | Ekelund et al. |
| 2012/0284893 | A1 | * | 11/2012 | Sohn ..... 2/46 |

OTHER PUBLICATIONS

Printed from Internet: http://shop.bebeaulait.com/Hooter-Hiders-New.

Printed from Internet: http://shop.bebeaulait.com/simple.

http://www.balboababy.com/nursing.html.

* cited by examiner

NURSING COVER-UP

CROSS-REFERENCES TO RELATED APPLICATIONS

This application is related to U.S. patent application Ser. No. 12/619,481, titled "Toy Attachment Systems and Methods" and filed Nov. 16, 2009, the entire disclosure of which is hereby incorporated by reference herein.

This application is also related to U.S. patent application Ser. No. 12/827,768, filed Jun. 30, 2010 and assigned to the same assignee as this application and titled "Shopping Cart Liner With Toy Attachment System," the entire disclosure of which is herein incorporated by reference.

This application is also related to U.S. patent application Ser. No. 12/827,823, filed Jun. 30, 2010 and assigned to the same assignee as this application and titled "Stroller Liner with Toy Attachment System", the entire disclosure of which is hereby incorporated by reference herein.

This application is also related to U.S. patent application Ser. No. 12/827,870, filed Jun. 30, 2010 and assigned to the same assignee as this application and titled "Pillow with Toy Attachment System", the entire disclosure of which is hereby incorporated by reference herein.

BACKGROUND OF THE INVENTION

This invention relates generally to the field of nursing cover-ups, and in particular to cover-ups having a variety of features to facilitate nursing while protecting a mother's privacy.

Many nursing mothers are concerned about unwanted exposure while nursing. This can be particularly problematic when the nursing mother is in a public area and needs to nurse her baby. Many times, there is simply no place of retreat where the mother can nurse. Even if there is a restroom, such facilities are often inconvenient or unsanitary.

BRIEF SUMMARY OF THE INVENTION

In one embodiment, the invention provides a nursing cover that comprises a flexible cover body that is configured to cover a mother's front, particularly areas exposed while nursing a baby. For convenience of reference, the cover body can be described in terms of a top end, a bottom end and two sides. A track is coupled to the top end of the cover, and at least one clip is slidingly engaged with the track to permit the clip to slide along the track. In this way, not only does the cover provide privacy protection to a nursing mother, but the cover also includes a slidable clip that can serve a variety of functions.

In one aspect, the track comprises a flexible material that is configured to bow outwardly from the mother's chest when the nursing cover is worn by the mother to permit the mother to view a baby while nursing. In other words, the bowing of the track moves the top end of the cover away from the mother's chest so that she can visualize the nursing baby while also having privacy from unwanted onlookers.

In another aspect, the track comprises a length of plastic that is sewn to the cover body. The length of plastic has a rounded edge about which the clip slides. As one example, the track may comprise a welt having at least a portion with a substantially circular cross section. In turn, the clip has a rounded channel that passes over the welt. One particular design may employ an upholstery edge roll for the track.

In a further aspect, the clip comprises a clip body that defines a slotted passage that is configured to fit over the track. As described above, the slotted passage can be generally circular.

The flexible cover may be constructed of a variety of materials, such as a fabric, sheet or the like. Also, a fastening arrangement may be placed about the mother's neck to position the flexible cover body over the mother's chest. In some cases the fastening arrangement comprises a pair of straps that are coupled to the top end and which may be fastened together to form a loop around the mother's neck. Conveniently, a fastening mechanism may be used to couple the pair of straps together. Further, the track may extend between the pair of straps.

In some cases the clip may define an opening for attaching an item to the clip, such as a burp cloth, pacifier or the like.

The invention in one embodiment also provides a method for covering a nursing baby. The method may utilize a nursing cover that comprises a flexible cover body having a top end, a bottom end and two sides, a track coupled to the top end, and at least one clip slidingly engaged with the track to permit the clip to be slid along the track. The nursing cover is attached about the mother's neck, with the track bowing outward so as to protect the mother from unwanted exposure while nursing. Also, the clip is moved from one location on the track to another location on the track.

One advantage of using the clip is that is may be moved from one end of the track to an opposite end of the track to represent which of the mother's breast is to be first used during a next feeding of the baby. Conveniently, an item may also be attached to the clip.

DETAILED DESCRIPTION OF THE INVENTION

The invention provides exemplary nursing covers and methods for their use. The nursing covers are generally constructed of sheet-like material that is draped about the front of the mother to cover the mother's chest and baby while nursing. One particular feature of the cover is the use of a track at or near the top edge of the cover that serves multiple functions. One of these is to hold the top end of the cover away from the mother's chest to permit the mother to visualize the baby while the cover remains draped over the baby. Another function is to permit a clip or other sliding device to be coupled to the track. This clip is able to slide along the track so as to be positionable anywhere along the top end of the cover. This clip can be used as a reminder for the mother as to which breast was last used when nursing the baby. Various items can also be attached to the clip, such as a burp cloth, pacifier, hanging pocket, pouch, or the like, and can be moved by sliding the clip along the track.

A track could also be positioned at other locations on the cover, such as in the middle of the cover, along the top end of a pocket of the cover, along straps used to hold the cover about the mother's neck, or along any of the sides of the cover.

Figure 1:
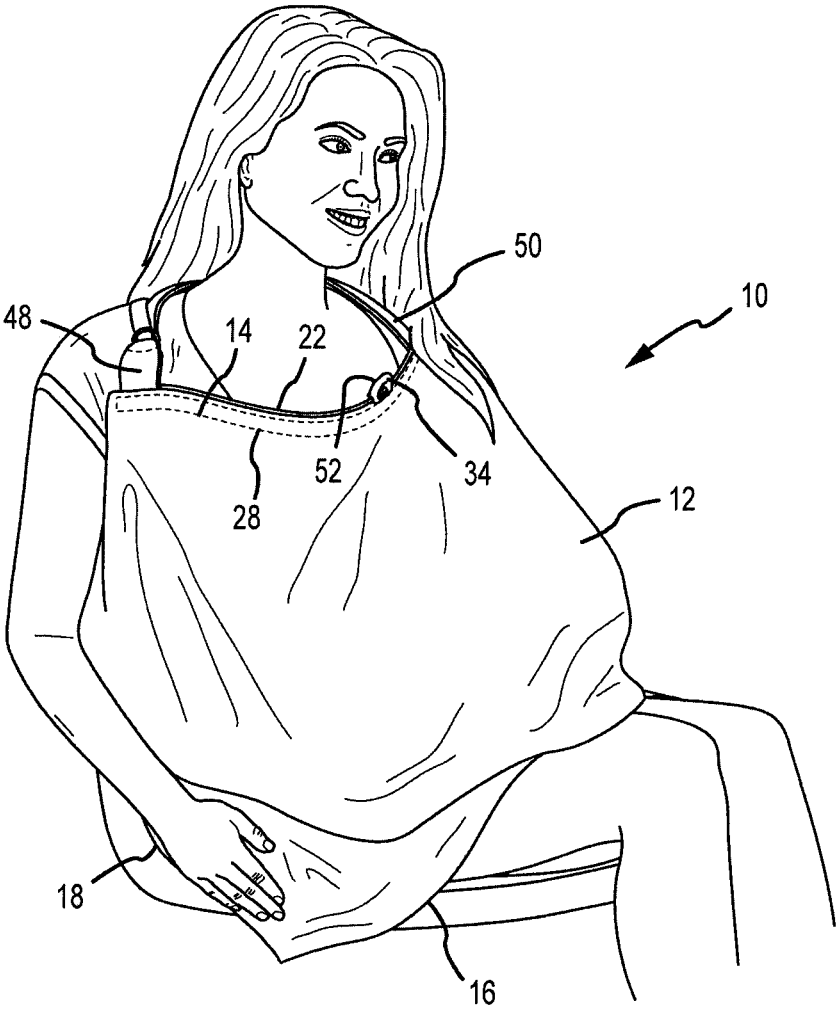
FIG. 1 illustrates one embodiment of a nursing cover shown being worn by a nursing mother according to the invention.
Figure 2:
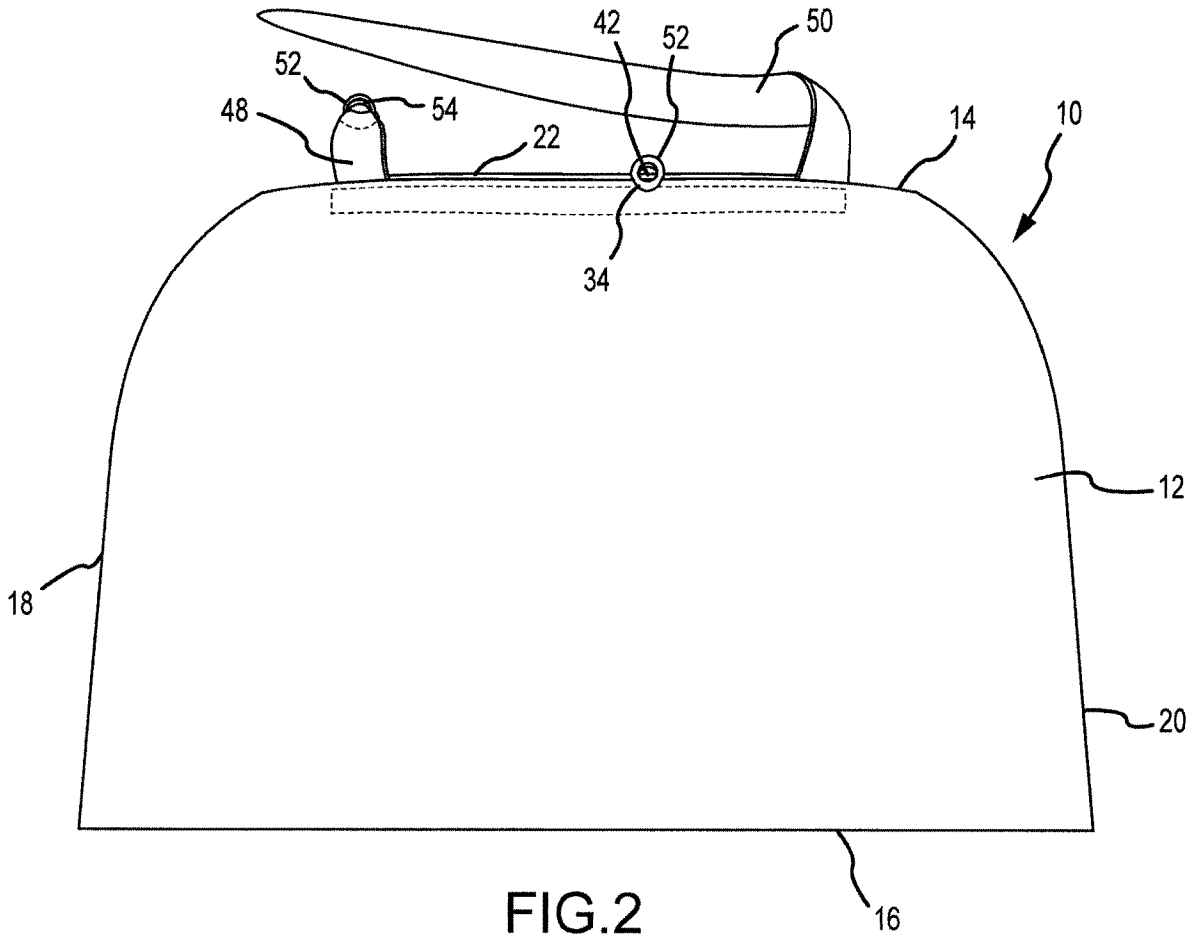
FIG. 2 is a front view of the nursing cover of FIG. 1.

Referring now to FIG. 1, one exemplary embodiment of a nursing cover 10 will be described. Cover 10 is shown being worn by a mother nursing a baby. As also shown in FIG. 2, cover 10 is constructed of a cover body 12 that is sized sufficiently to cover the mother's chest. Typically, the cover body 12 will extend at least to the mother's waist so as to also cover and protect the nursing baby. In some cases, cover body 12 could be long enough to extend to the mother's feet to provide additional covering. This could be useful in cases where the cover 10 serves as a blanket or to protect against the sun or wind.

A wide variety of materials may be used to construct cover body 12. Examples of fabrics that can be used include cotton, polyester, wool, nylon, silk, denim, or the like. Also, blends of these materials could also be used. These materials will preferably be lightweight and breathable to properly ventilate the infant. However, in some cases, heavier fabrics, such as fleece, or padded or quilted fabrics could also be used to provide warmth in colder environments.

For convenience of discussion, cover body 12 can be described in terms of a top end 14, a bottom end 16 and two sides 18 and 20. Cover body 12 is generally rectangular in shape, although one or more of the corners may be rounded. Also, it will be appreciated that other shapes could also be used, including oblong, oval, square, or other shapes to facilitate coupling to the mother while providing adequate coverage. When cover body 12 is constructed of a fabric, the edges may conveniently be folded and sewn as is known in the art.

Although not shown, it will be appreciated that various items could be coupled to cover body 12, such as pockets, appliqués, a hood, and the like. Also, various decorative patterns could be applied. In some cases, one or more holes or openings can be provided through cover body 12 to provide ventilation or additional access through the cover.

Coupled to top end 14 is a track 22. Top end 14, including track 22, are illustrated in greater detail in FIG. 3. Track 22 comprises a welt 23 having an extruded plastic having a round edge 30 and an extended portion 32. Round edge 30 is employed to receive a clip 34, while extended portion 32 is used to couple track 22 to cover body 12.

Track 22 may be coupled to cover body 12 in a variety of ways. For example, fabric pockets may be sewn to cover body 12 at two locations where ends of track 22 are to be positioned. As shown in FIG. 2, the single track 22 is coupled to top end 14 and has a continuous, smooth surface. The track 22 is coupled to the cover body along substantially the entire length of the track 22. The track ends are held by the pockets which provide protection against the ends of the track 22 which might otherwise rub against the mother. Track 22 may be sewn directly to cover body 12 to secure it to the cover body. Further, a piece of fabric 26 may be sewn to top end 14 using sew lines 28 to cover the back or mother-facing side of the track. As shown, extended portion 32 is covered by the piece of fabric 26 while edge 30 extends above top end 14. Sew lines typically also extend completely through track 22 to secure track 22 to the cover body. A fabric glue could also be used to secure track 22 to cover body 12. Use of the end pockets and fabric 26 thus allows the ends of track 22 and the side of track 22 facing the mother to be fully encased in fabric so as to not scrape the mother. As another option, a fabric pocket or protecting strip may be created by cutting a slit in cover body 12, folding the fabric back on itself and completing the pocket using sew lines. Track 22 could also be coupled in other ways, such as by directly gluing track 22 to cover body 12 or by using other fasteners, such as a hook and loop fabric. Other techniques for coupling a track to a fabric are described in U.S. patent application Ser. Nos. 12/619,481, 12/827,768, 12/827,823, and 12/827,870, previously incorporated by reference.

One advantage of using track 22 is that it assists in separating top end 14 from the mother's chest a distance sufficient to permit the mother to look down and visualize her nursing baby. At the same time, top end 14 does not gape to the extent that her privacy is compromised. One way to accomplish this is by constructing track 22 of a relatively firm but flexible material that bows outward when cover 10 is worn by a mother. Because track 22 is secured to cover body 12, when cover 10 is worn by a mother, the curvature of cover body 12 about the mother's body causes track 22 to bow outwardly, thus separating top end 14 from the mother's chest. Examples of materials that can be used include plastics, fiberglass, rubber, wood and the like. While track 22 generally has a straight configuration when cover 10 is not in use, track 22 could be permanently curved in an outwardly bowed shape. Also, track 22 could be constructed of a memory material that tends to return to a curved shape.

Although shown as an extruded piece, track 22 could also be a simple rod. Further, although shown as a stand alone track, in some cases, the track could completely be encased in a fabric. This fabric in turn may be used to couple the track to the cover body. Examples of how to encase the track in a fabric are generally described in U.S. patent application Ser. Nos. 12/619,481, 12/827,768, 12/827,823, and 12/827,870, previously incorporated by reference. These patent applications describe other ways to manufacture tracks and couple them to fabrics and may also find use with the covers described herein.

Figure 4:
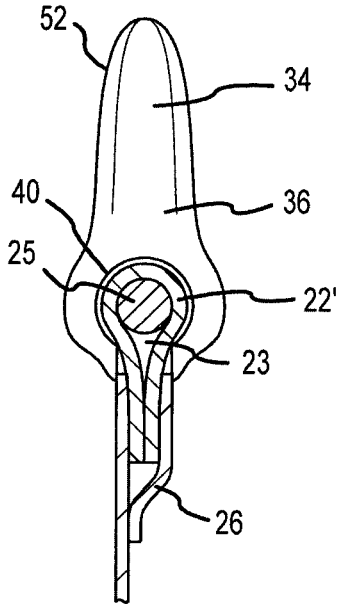
FIG. 4 is a cross sectional side view of another embodiment of a top portion of the nursing cover of FIG. 2.

FIG. 4 shows a further alternative embodiment of how to construct a track 22'. Track 22' is similar to track 22, except that track 22' includes an elongate channel 23 that extends through track 22'. Running the length of channel 23 is a flexible rod 25. In some cases, track 22' comprises an extruded plastic, and rod 25 comprises a flexible material such as plastic, wire or the like that is extended through channel 23. Use of rod 25 assists in enhancing the ability of track 22' to bow outward when worn by the mother as well as providing sufficient rigidity so that a clip may slide along track 22'.

Figure 3:
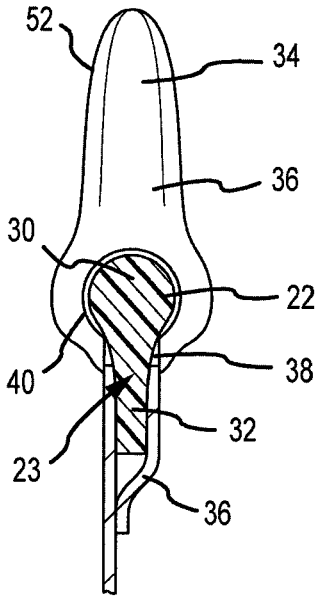
FIG. 3 is a cross section side view of a top portion of the nursing cover of FIG. 2.

Clip 34 comprises a clip body 36 that includes a slotted passage 38 for receiving track 22. More specifically, edge 30 of track 22 can be pressed through slotted passage 38 until it snaps into a rounded region 40. In so doing, clip body 36 may flex sufficient to allow edge 30 to pass through passage 38. Further details of clip 34 are described in the patent applications previously incorporated by reference. Once secured on track 22, clip 34 may be slid anywhere along the track. As shown in FIGS. 3 and 4, clip body 36 includes an extension 52 that extends outward from track 22. Extension 52 is configured to be grasped and used to slide clip 34 along track 22.

Figure 5:
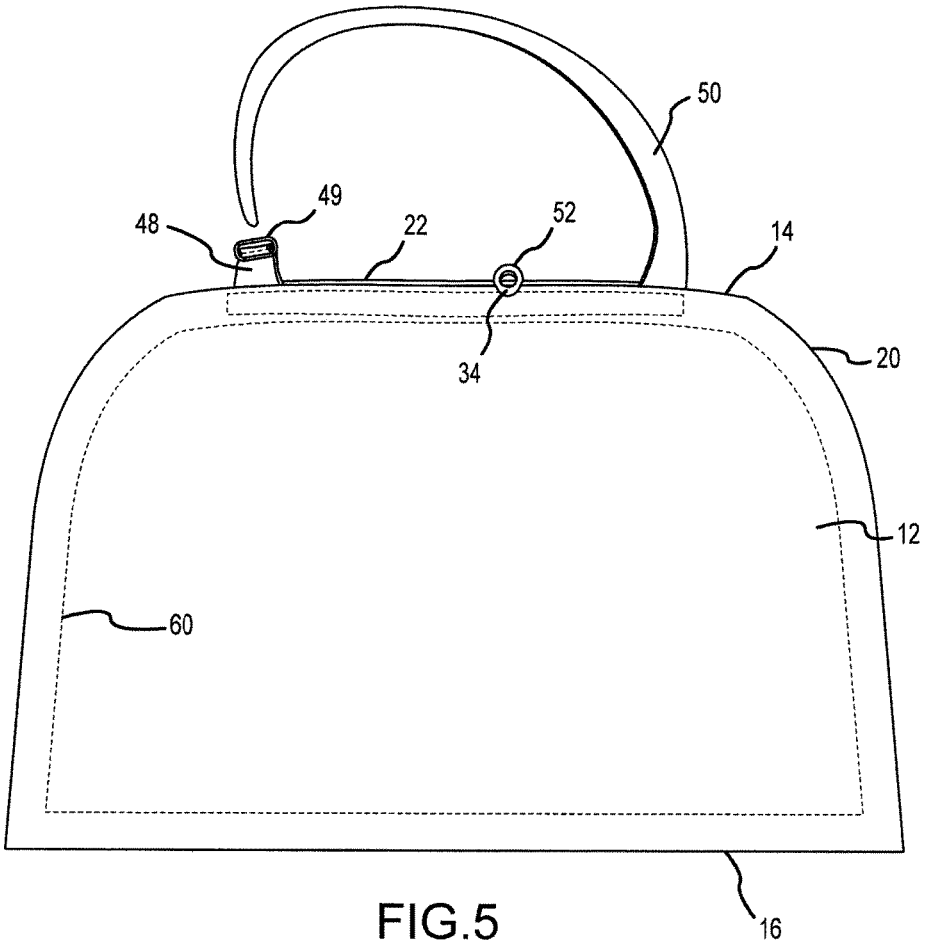
FIG. 5 illustrates the nursing cover of FIG. 2 with an alternative fastening mechanism.

Conveniently, clip 34 may include an opening 42 that allows various items to be connected to clip 34. As shown in FIGS. 1, 2, and 5, opening 42 can be positioned in extension 52. Merely by way of example, items that could be connected to clip 34 include a cloth or small towel, a pacifier, a music player, various kinds of electronics, including time pieces, toys, nursing pads, and the like. Further, any of the attachments described in the previously described patent applications could also be connected to clip 34. This may be done using a string or tether that is coupled to the clip. For instance, a pocket or pouch attached to a tether could be coupled to clip 34. Alternatively, the item could be directly held by clip 34. Also, clip 34 could include its own fastener, such as a hook and loop fastener material, button, snap or the like to facilitate the attachment of an item.

One particular advantage of clip 34 is that it may be used as a reminder as to which breast the mother last used during a feeding. To do this, the clip can be slid to one side or the other along track 22. In this way, the mother simply need to look at the location of clip 34 to determine where to next begin feeding.

The size of opening 42 may depend on the particular application. Typically, opening 42 will have a diameter in the range from about ¼ inch to about 2 inches. In some cases multiple openings may be provided. Further, in some cases, such as where clip 34 is used as a reminder, no hole may be needed.

Although the overall shape of clip 34 is shown as generally round, other shapes and configurations may be used as well. For instance, clip 34 could have various fanciful shapes, such as a flower, plant, figure or the like, or may be suggestive, such as in the shape of an arrow, a letter or a number. Clip 34 could also be solid so that it does not include an opening. In some cases, more than one clip could be used on the same track. Also, the clip could be configured to project laterally away from the mother. Various possible designs for clip 34 are described in the patent applications previously incorporated by reference.

To secure cover body 12 to the mother, a fastening arrangement may be used. Typically, this may be accomplished by strapping cover body 12 about the mother's neck. To do so, a pair of straps 48 and 50 may be used. A pair of rings, such as D rings 52 and 54, may be used to couple straps 48 and 50 together, either before or after straps 48 and 50 are placed about the neck. As shown, strap 50 is longer than strap 48. However, strap 48 could be longer, or both could be the same length. Also, a variety of other fasteners could be used instead of rings. Such fasteners include snaps, ties, buttons, clips, clasps, a single ring, a hook and loop fastener material, or by simply tying the two straps together. Further, in some cases only a single strap may be warranted.

Conveniently, track 22 may extend between straps 48 and 50 to provide a convenient stop for clip 34 as it is moved side to side along track 22. In some cases, track 22 could extend beyond straps 48 and 50 and could even along one or more sides of cover body 12.

Rather than using straps, cover body 12 could simply include a hole through which the mother's head extends, similar to a poncho. Cover 10 could also include other straps, such as near the mother's waist. Further, in some cases, cover body 12 may be configured as a shirt or jacket having a zipper, buttons or ties to secure the cover body together.

Figure 6:
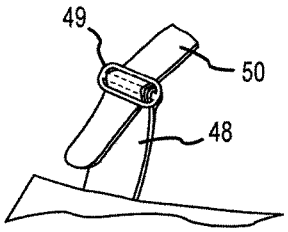
FIG. 6 is a more detailed view of the fastening mechanism of FIG. 5 shown fastening two straps together.

FIGS. 5 and 6 illustrate another embodiment of a fastening mechanism 49 that may be used to couple straps 48 and 50 together. Fastening mechanism 49 comprises a ring with a center rail about which strap 48 is coupled by looping an end of strap 48 about the rail. Strap 50 passes beneath one side of the ring, above the center rail, then back beneath a far side of the ring. FIG. 6 also illustrates sew lines 60 that are used when forming a folded edge about the periphery of cover body 12.

The invention has now been described in detail for purposes of clarity and understanding. However it will be appreciated that certain changes and modifications may be practiced within the scope of the appended claims.

What is claimed is:

1. A nursing cover, comprising:

a flexible cover body that is configured to cover at least a mother's chest, the cover body having a top end with a top edge, a bottom end with a bottom edge and two sides;

a fastening arrangement that is configured to be placed about the mother's neck to position the flexible cover body over the mother's chest, wherein the fastening arrangement comprises a pair of straps that each have an end, and wherein the ends of the straps are coupled to the top end of the cover body at two separate and laterally spaced apart locations on the cover body to permit the two straps to be fastened together to form a loop around the mother's neck;

a single track coupled to the top edge, the track having a length, a round edge along the length and a continuous, smooth surface, wherein the track is coupled to the cover body along substantially the entire length of the track;

at least one clip comprising a clip body having a slotted passage that fits over the track and a rounded region that receives the round edge of the track, wherein the clip is slidingly engaged with the track to permit the clip to be slid along the entire length of the track, and wherein the clip includes an extension that extends outwardly from the track and that is sized and configured such that it may be grasped to slide the clip along the track.

2. A nursing cover as in claim 1, wherein the track comprises a flexible material that is configured to bow outwardly from the mother's chest when the nursing cover is worn by the mother to permit the mother to view a baby while nursing.

3. A nursing cover as in claim 1, wherein the track comprises a length of plastic that is sewn to the cover body.

4. A nursing cover as in claim 1, wherein the track comprises a welt having at least a portion with a substantially circular cross section.

5. A nursing cover as in claim 4, wherein the welt comprises an upholstery edge roll.

6. A nursing cover as in claim 1, wherein the flexible cover comprises a fabric.

7. A nursing cover as in claim 1, further comprising a fastening mechanism to couple the pair of straps together.

8. A nursing cover as in claim 1, wherein the track extends between the pair of straps.

9. A nursing cover as in claim 1, wherein the clip defines an opening for attaching an item to the clip.

10. A nursing cover as in claim 1, wherein the cover body has a length that extends at least to the mother's waist.

11. A nursing cover as in claim 1, wherein the extension of the clip defines an opening having a diameter in the range from about ¼ inch to about 2 inches.

12. A nursing cover as in claim 1, wherein the extension of the clip has a rounded end.

* * * * *